US010426315B2

(12) United States Patent
Pugh et al.

(10) Patent No.: US 10,426,315 B2
(45) Date of Patent: Oct. 1, 2019

(54) DISHWASHER

(71) Applicant: WHIRLPOOL CORPORATION, Benton Harbor, MI (US)

(72) Inventors: Jonathan D. Pugh, Benton Harbor, MI (US); Michael Kahwaji, St. Joseph, MI (US); William J. Snell, Elkhart, IN (US); Michael R. Mackay, St. Joseph, MI (US); Ameresh B. Viswanathan, St. Joseph, MI (US); Joseph T. Ferencevich, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/437,760

(22) Filed: Feb. 21, 2017

(65) Prior Publication Data

US 2018/0235432 A1 Aug. 23, 2018

(51) Int. Cl.
*A47L 15/50* (2006.01)

(52) U.S. Cl.
CPC ..... *A47L 15/505* (2013.01); *A47L 15/502* (2013.01); *A47L 15/507* (2013.01)

(58) Field of Classification Search
CPC ..... A47L 15/50; A47L 15/502; A47L 15/503; A47L 15/504; A47L 15/505; A47L 15/507
See application file for complete search history.

(56) References Cited

U.S. PATENT DOCUMENTS 2,309,212 A * 1/1943 Reeves ..... F25D 25/02 211/153
2,598,962 A * 6/1952 Anseele ..... B65D 7/36 220/614
2,721,661 A * 10/1955 Wolf ..... A47L 15/50 211/41.8
3,126,098 A * 3/1964 Geiger ..... A47L 15/50 134/144
3,203,557 A * 8/1965 Ettlinger, Jr. ..... A47L 15/501 211/41.4
3,269,548 A * 8/1966 Geiger ..... A47L 15/50 134/165
3,333,722 A * 8/1967 Panknin ..... B65D 7/14 206/503
3,693,823 A * 9/1972 Rehrig ..... B65D 7/20 206/427
3,923,187 A * 12/1975 Johansson ..... B65D 7/20 206/503
4,527,707 A * 7/1985 Heymann ..... A47L 19/02 211/126.1

(Continued)

FOREIGN PATENT DOCUMENTS

EP 1477101 A2 * 11/2004 ..... A47L 15/50
EP 2798996 B1 8/2015

(Continued)

*Primary Examiner* — Kimberley S Wright
(74) *Attorney, Agent, or Firm* — McGarry Bair PC

(57) ABSTRACT

A dishwasher having a tub at least partially defining a wash chamber wherein the wash chamber has an access opening, having a first dishrack movably mounted to the tub, a second dishrack, and at least a first and second removable dishrack supported and having corresponding first and second sets of support elements.

15 Claims, 10 Drawing Sheets

(56) References Cited

U.S. PATENT DOCUMENTS 5,158,185 A * 10/1992 Michael ..... A47L 15/503 134/200
5,199,415 A * 4/1993 Johnson, Jr. ..... F24B 1/198 108/27
5,626,242 A * 5/1997 Weizer ..... A47L 15/50 211/151
6,109,455 A * 8/2000 Schroeder ..... A47L 15/505 211/41.9
6,571,965 B1 * 6/2003 Beck ..... A47L 15/503 211/41.8
6,622,740 B1 * 9/2003 Durazzani ..... A47L 15/0084 134/115 R
D493,308 S * 7/2004 Nilsson ..... D3/306
6,786,339 B2 * 9/2004 Deiss ..... A47L 15/505 211/41.8
7,174,605 B1 * 2/2007 Nawrocki ..... A45C 13/28 16/422
7,228,985 B2 * 6/2007 Yeh ..... B62D 25/084 220/485
D568,646 S * 5/2008 Snider ..... D3/306
8,006,858 B2 * 8/2011 Cheng ..... A47B 55/02 220/485
8,118,179 B2 * 2/2012 Smith ..... A47J 47/16 211/41.5
8,141,737 B1 * 3/2012 Tsai ..... B65D 7/14 220/485
8,584,889 B2 * 11/2013 Cheng ..... A47B 55/02 220/485
8,746,467 B2 * 6/2014 Jeong ..... A47L 15/502 211/126.2
8,813,766 B2 * 8/2014 Bhajak ..... A47L 15/504 134/135
9,113,773 B2 * 8/2015 Bartloff ..... A47B 95/043
9,119,524 B2 * 9/2015 Renz ..... A47L 15/505
9,186,038 B2 * 11/2015 Bastuji ..... A47L 15/502
9,241,608 B2 * 1/2016 Shin ..... A47L 15/504
D773,751 S * 12/2016 Hederstierna ..... D32/3
9,687,074 B2 * 6/2017 Cheng ..... A47B 88/40
9,763,556 B2 * 9/2017 Kaberg ..... A47L 15/502
9,848,754 B2 12/2017 Baldwin et al.
D814,190 S * 4/2018 Mishan ..... D3/306
2003/0102315 A1 * 6/2003 Cheng ..... A47B 55/02 220/485
2004/0208689 A1 * 10/2004 Dijkstra ..... B65D 7/24 403/256
2005/0077299 A1 * 4/2005 Cheng ..... A47B 55/02 220/485
2006/0254992 A1 * 11/2006 Lim ..... A47L 15/505 211/41.9
2009/0045201 A1 * 2/2009 Cheng ..... A47B 55/02 220/494
2011/0253650 A1 * 10/2011 Renz ..... A47L 15/503 211/41.9
2013/0299438 A1 11/2013 McDaniel et al.
2014/0042113 A1 * 2/2014 Cheng ..... A47B 55/02 211/126.15
2014/0190528 A1 * 7/2014 Wegener ..... A47L 15/502 134/92
2014/0197121 A1 * 7/2014 Knight ..... A47B 45/00 211/86.01
2014/0285077 A1 * 9/2014 Yoon ..... A47L 15/503 312/228.1
2014/0291266 A1 * 10/2014 Yang ..... A47B 96/00 211/126.15
2015/0164301 A1 * 6/2015 Bartloff ..... A47B 95/043 211/41.8
2015/0196189 A1 7/2015 Shaffer et al.
2015/0257623 A1 * 9/2015 Beshears, Jr. ..... A47L 15/4282 134/172
2015/0320290 A1 * 11/2015 Hederstierna ..... A47L 15/502 211/41.9
2015/0327749 A1 * 11/2015 Kaberg ..... A47L 15/502 211/41.9
2017/0027412 A1 * 2/2017 Chan ..... A47L 15/503
2017/0071337 A1 * 3/2017 Cheng ..... A47B 55/02

FOREIGN PATENT DOCUMENTS

FR 1338288 A * 9/1963 ..... B65D 7/14
GB 2349330 A * 11/2000 ..... A47L 15/505
WO 2005111521 A1 11/2005
WO WO-2005111521 A1 * 11/2005 ..... A47B 73/002

* cited by examiner

DISHWASHER

BACKGROUND OF THE INVENTION

Front loading dishwashers include a tub having an open front. The tub defines a washing chamber into which dishes are placed to undergo a washing operation. The dishwasher is generally provided with a door, pivotally mounted to the tub, that closes the open front, and upper and lower extensible dishracks for supporting items during the washing operation.

Typically, the upper and lower dishrack configurations are defined by the manufacturers whom have developed adjustment mechanisms that enable limited configuration of a dishrack, such as vertical adjustability of at least one dishrack, flip-down and/or sliding rows. Typically, these mechanisms are directed toward the accommodation of different sized items, not more of one type of item or another.

BRIEF DESCRIPTION OF THE INVENTION

In one aspect of the present disclosure, a dishrack for a dishwasher can comprise: a non-wire-frame frame forming a periphery of the dishrack and having a ledge; and at least one wire-frame insert resting on the ledge.

In another aspect of the present disclosure, a dishrack can include a peripheral frame defining an interior. A first insert rests on at least a portion of the frame and has a first set of support elements shaped to support glasses. A second insert rests on at least a portion of the frame and has a second set of support elements shaped to support bowls. A third insert rests on at least a portion of the frame and has a third set of support elements shaped to support plates.

In yet another aspect of the present disclosure, a dishwasher can comprise: a tub at least partially defining a wash chamber with an access opening; a first dishrack movably mounted to the tub; and a second dishrack having a peripheral frame and at least a first and second removable dishracks supported on the peripheral frame and having corresponding first and second sets of support elements having corresponding first and second profiles, with the first and second profiles being different.

DESCRIPTION OF EMBODIMENTS OF THE INVENTION

Figure 1:
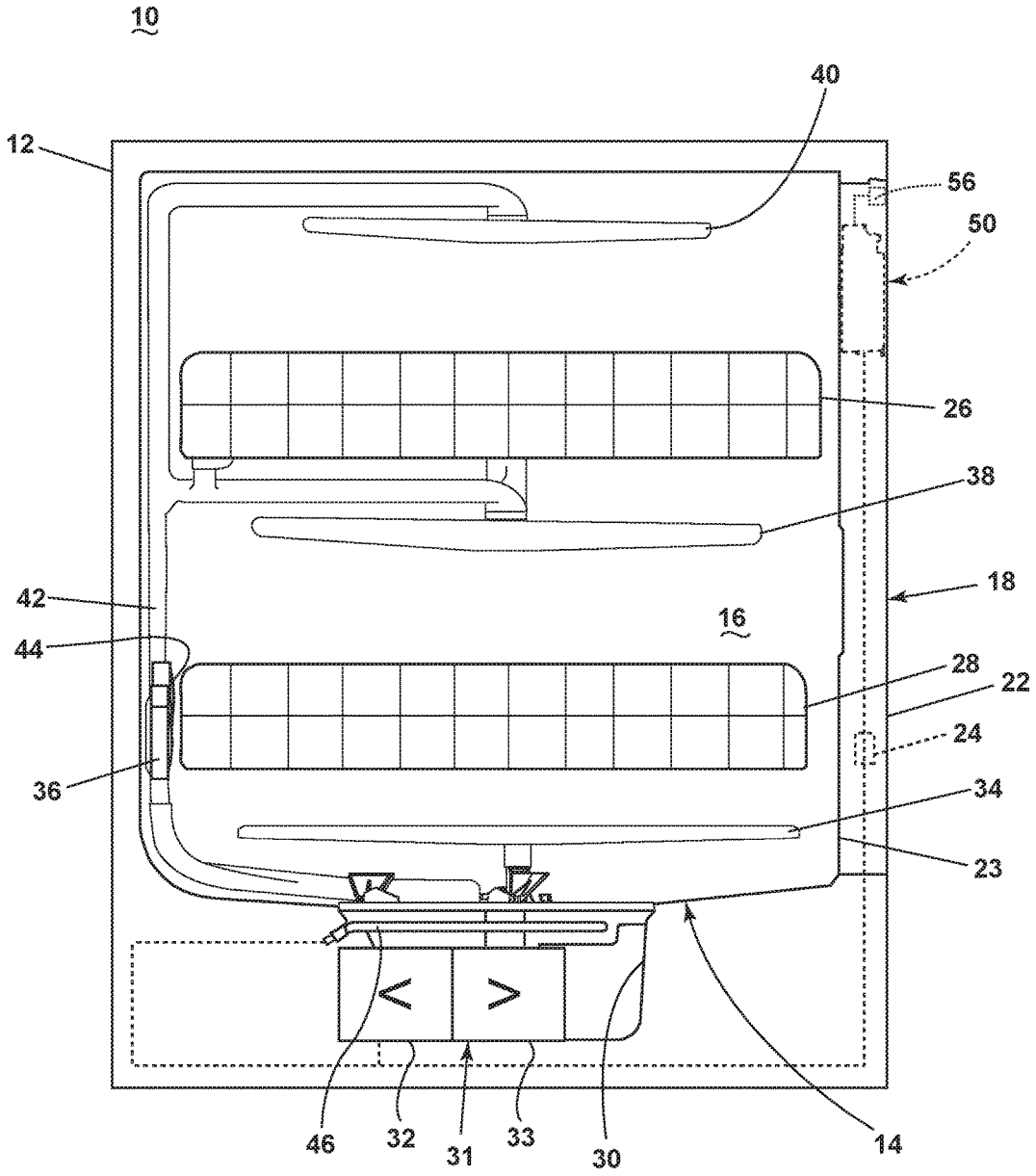
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding of the invention. A chassis 12 can define an interior of the dishwasher 10 and may include a frame, with or without panels mounted to the frame. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

The door assembly 18 can be movably mounted to the dishwasher 10 for movement between opened and closed positions to selectively open and close the open face of the tub 14. Thus, the door assembly 18 provides a seal to the treating chamber 16 during a washing operation and accessibility to the treating chamber 16 for the loading and unloading of dishes or other washable items. Door assembly 18 has an exterior panel 22 and an interior panel 23 that can be provided with a dispensing assembly 24 within which a consumer can place liquid, particulate or gel washing detergent for dispensing at predetermined periods of the washing operation.

A plurality of dishracks, illustrated in the form of upper and lower dishracks 26, 28, are located within the treating chamber 16 and receive dishes or other items for washing. The upper and lower racks 26, 28 are typically mounted for slidable movement in and out of the treating chamber 16 for ease of loading and unloading. Additional dishracks can also be provided. Other dish holders can be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dishrack 28 toward the rear of the treating chamber 16. The second lower spray assembly 36 is illustrated as including a vertically oriented distribution header or spray manifold 44. Such a spray manifold is set forth in detail in U.S. Pat. No.

7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
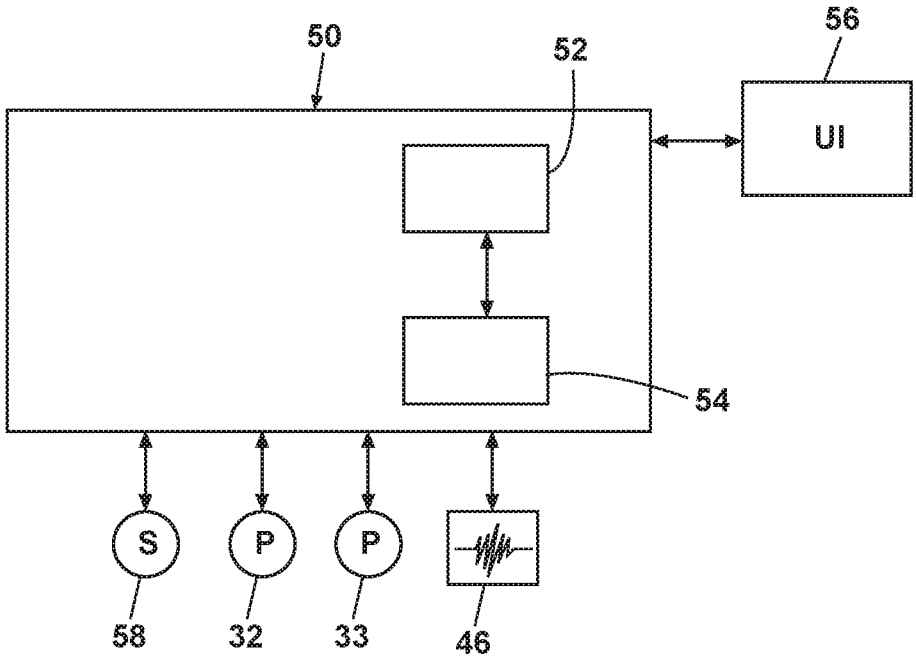
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

As the exact structure and operation of the spray, recirculation or heating assemblies of dishwasher 10 are not part of the present invention, it will not be discussed further herein. Instead, the present invention is directed to the particular details of the configuration and function of dishracks 26 and 28. However, it should be noted that the invention can be employed in connection with various types of dishwashers, including the conventional type of FIG. 1 and drawer dishwashers. Of course, with drawer dishwashers, the dishrack may not be extensible, however the dishrack configuration could still be customizable.

Figure 3:
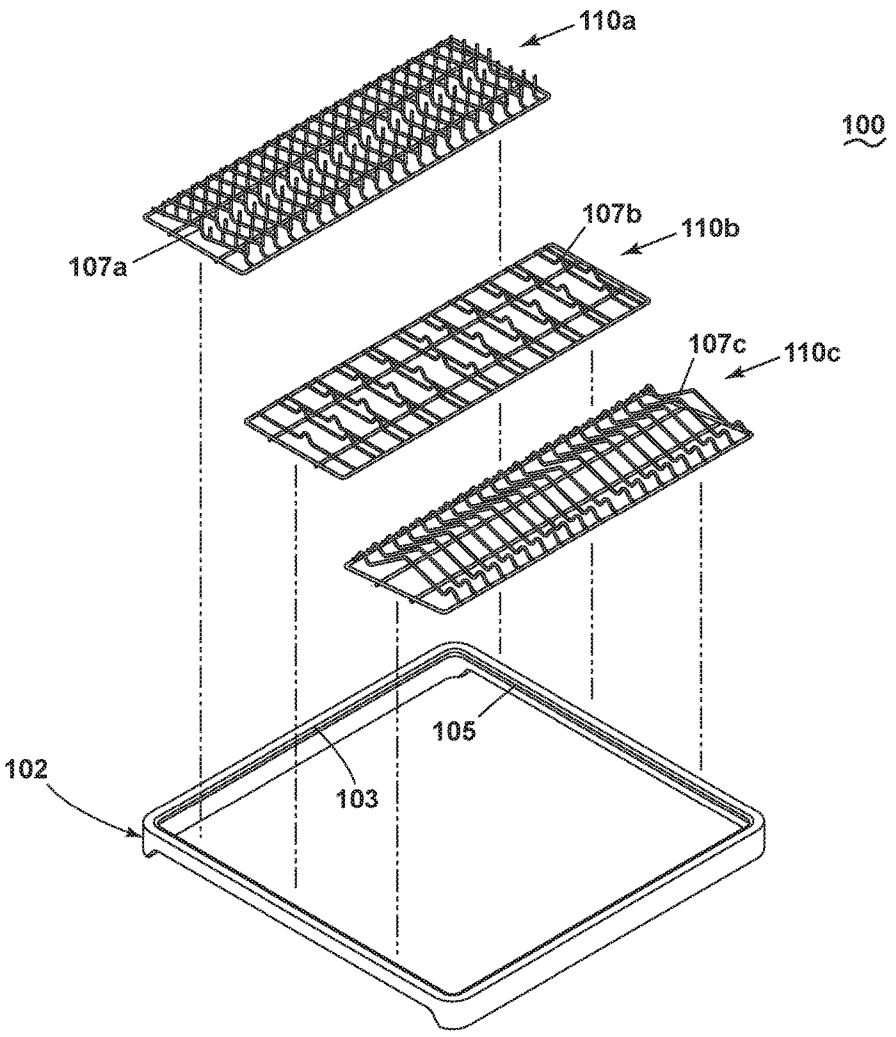
FIG. 3 is a perspective view of a dishrack suitable for use as either of the dishracks in the dishwasher of FIG. 1 according to aspects of the present disclosure.

FIG. 3 illustrates an exemplary dishrack 100 suitable for use as either or both dishracks 26, 28. The dishrack 100 comprises a frame 102 on which is supported multiple inserts 110*a-c*. The inserts 110*a-c* comprise a plurality of support elements 107*a-c* configured to define one or more profiles shaped to receive a specific dish type. The inserts 110*a-c* while illustrated as three different inserts, each designed for holding a different type of dish, the number of inserts can be more or less than three, and some or all of the inserts can be duplicates of each other. For purposes of this description, when referring to the inserts generally, the numeral 110 will be used without the suffix a-c. When referring to a specific insert the numeral 110 will be used in combination with the appropriate suffix a-c.

In the present example, inserts 110 can be constructed of coated wire, however, alternatively, inserts 110 can be constructed of the same or different materials including, but not limited to, thermoformed plastic, stainless steel, other metal, or any such material able to withstand the conditions of the treating chamber 16 while supporting the dishes loaded into the chamber 16 to be treated. The inserts 110 may have one or more support elements 107*a-c*, which can include, cross-members, utensil baskets, vertical members, or any other such element able to receive dishes to be treated. Support elements 107*a-c* can be constructed of the same or different material as the insert 110 including, but not limited to, coated wire, thermoformed plastic, stainless steel, other metal, or any such material able to withstand the conditions of the treating chamber 16 while supporting the dishes loaded into the chamber 16 to be treated.

Figure 4:
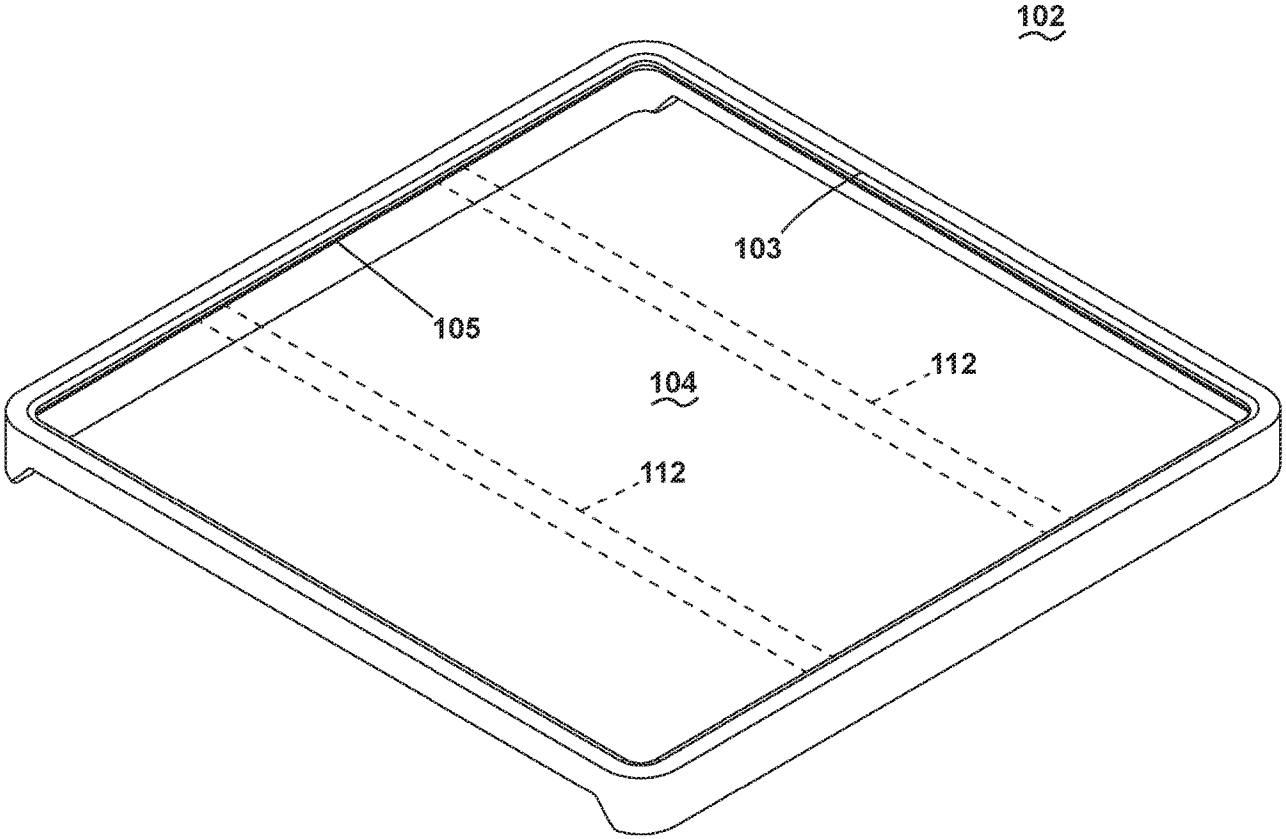
FIG. 4 is a perspective view of an exemplary frame of a dishrack of FIG. 3 according to aspects of the present disclosure.

Referring to FIG. 4, the frame 102 forms a periphery 103 defining an interior 104. A ledge 105 is located on the periphery 103 and forms a seat for the one or more inserts 110. Frame 102, in the present example, is a molded plastic, non-wire frame, however, frame 102 can be constructed of coated wire, thermoformed plastic, stainless steel or other metal.

Optionally, the frame 102 can comprise one or more additional supports 112 arranged in a manner to provide support to the inserts 110 selected for the dishrack 100. The additional supports 112 can be in fixed in locations on frame 102 requiring support to prevent the frame 102 from deforming under the weight of the items added to the dishrack 100 or to maintain the user's ability to slidably maneuver the dishrack 100 in and out of the treating chamber 16. Furthermore, additional supports 112 can provide support to one or more inserts 110 received in the frame 102. Alternatively, the additional supports 112 can be removable or a combination of both fixed and removable supports in order to provide support to locations as an insert 110 configuration or a load of dishes require. The additional supports 112 can be constructed of the same or different material as the frame 102 including, but not limited to, coated wire, thermoformed plastic, or metal. The removable additional supports 112 can be secured to the frame 102 by fasteners (not shown) including but not limited to clamps, clips, tension mounts, spring loaded mountings, or any other suitable means to secure the additional supports 112 to the frame 102.

One or more inserts 110 can be removably received in the periphery 103 of frame 102 and can be arranged side-by-side in a horizontal orientation, a vertical orientation, or a combination of both with each insert 110 supported on a different portion of the frame 102. The removable inserts 110 can optionally be secured to the sides of the frame 102 by means including but not limited to clamps, clips, tension mounts, spring loaded mountings, abutting relationship with the ledge 105 of the frame 102. In addition, any insert 110 received in frame 102 can be in an abutting relationship to any adjacent side of any other insert 110 where the abutting relationship includes, but is not limited to, resting, abutting, overlapping, or connection through clips, clamps, or any other means to secure adjacent sides of one or more inserts 110 to each other. Alternatively, one or more inserts 110 can be fixedly received in frame 102 on the ledge 105.

Figure 5A:
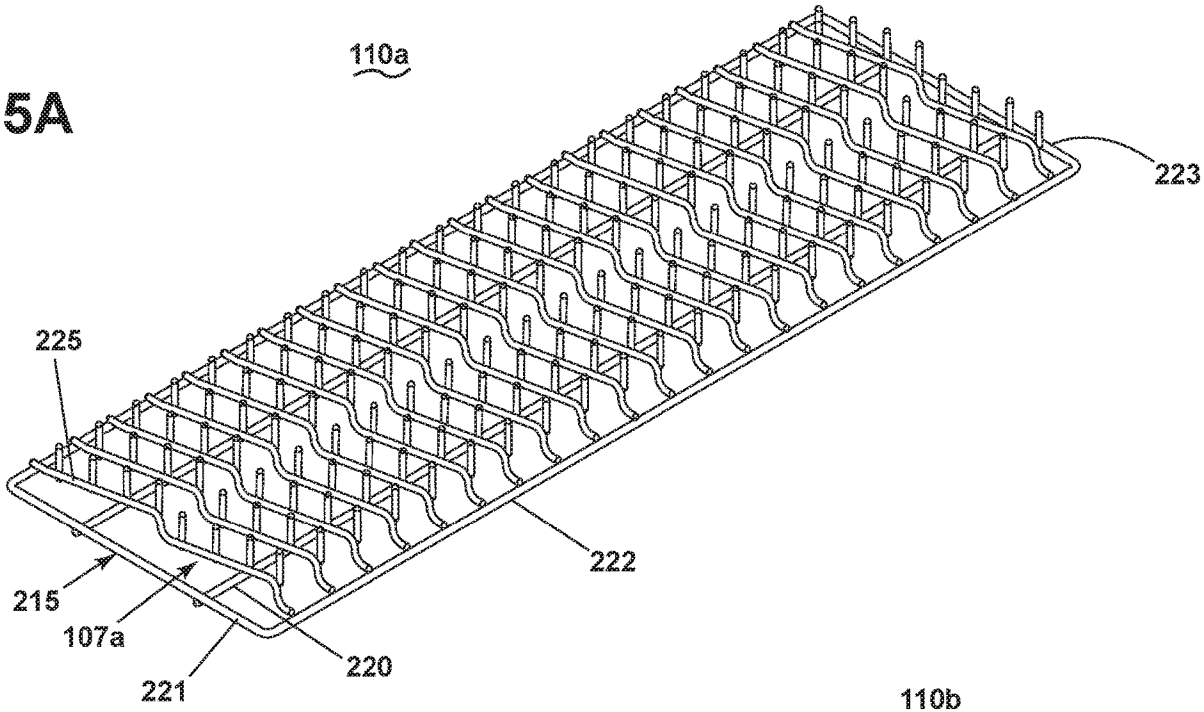
FIG. 5A is a perspective view of a universal dishrack insert according to aspects of the present disclosure.

Referring to FIG. 5A, a universal dishrack insert 110*a* for receiving multiple types of dishes of dishwasher 10 according to aspects of the present disclosure will now be described in detail. As used in this description, the term "universal" is intended to indicate that the dishrack insert is configured to be loaded with multiple types of dishes and is not specifically designed for one particular type of dish. Universal dishrack insert 110*a* comprises an outer peripheral wire-frame element 215 that can rest on the ledge 105 of frame 102. Peripheral wire-frame element 215 can comprise at least two spaced side elements 222 that along with a front element 221 and a back element 223 form a complete rectangle. One or more support elements 107*a* in the form of wire-frame cross members 225 spanning the spaced side elements 222 can be configured to receive dishware. Insert 110*a* can further comprise one or more longitudinally arranged stabilizing wires 220 spanning the front element 221 and the back element 223 of the peripheral wire-frame element 215 that can support dishes loaded onto the insert 110*a* and can provide additional support to the insert 110*a* to prevent insert 110*a* from deforming under the weight of the dishes.

Figure 5B:
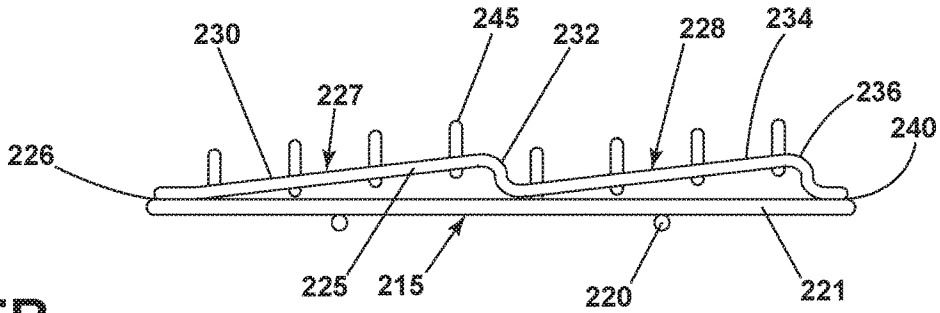
FIG. 5B is a front view of the profile of the universal dishrack insert of FIG. 5A.

Referring to FIG. 5B, the wire-frame cross members 225 can comprise a stepped profile that can collectively define at least two effectively planar surfaces 227 and 228. In the present example, the wire-frame cross member 225 is fixedly attached at a first end 226 to wire-frame element 215. The wire-frame cross member 225 continues in a first incline slope 230 to a first curved decline 232, followed by a second incline slope 234 and a second curved decline 236 before terminating at the second end 240 fixedly attached to the wire-frame element 215. Additionally, the first incline slope 230 and the second incline slope 234 each can have one or more projections 245 in evenly spaced apart relationship projecting upward from the wire-frame cross member 225.

Figure 5C:
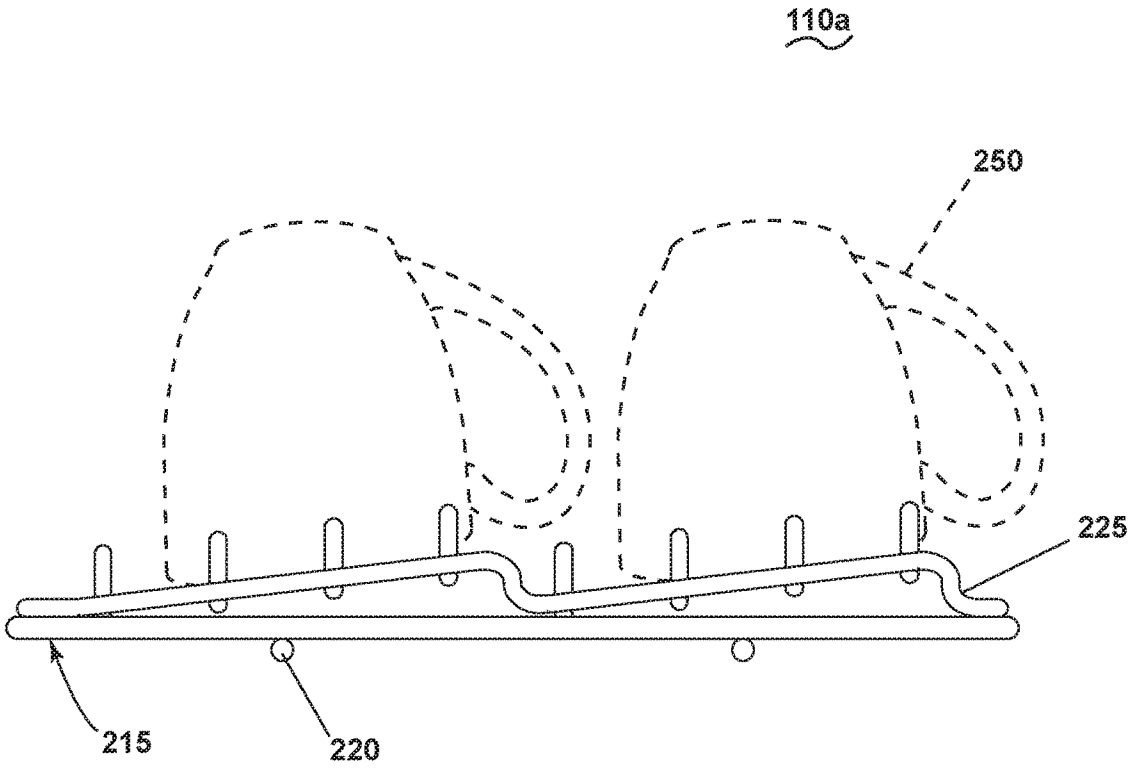
FIG. 5C is identical to FIG. 5B, except for the additional of exemplary cups showing one possible loading of dishes on the universal dishrack insert.

Referring to FIG. 5C for the purposes of illustration, the stepped profile configuration of the wire-frame cross members 225 of insert 110*a* can receive a mug 250 or any other type of glassware including but not limited to glasses, mugs, cups, or other similarly shaped dishes.

Figure 6A:
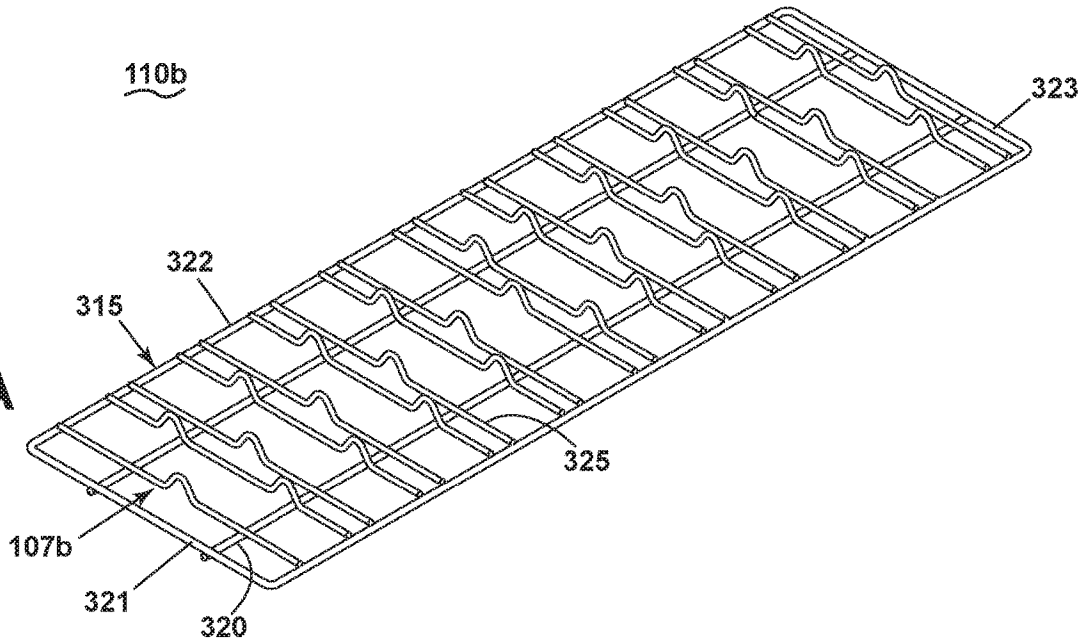
FIG. 6A is a perspective view of a bowl dishrack insert according to aspects of the present disclosure.

FIG. 6A is a perspective view of a dishrack insert 110*b* for receiving bowls of dishwasher 10 according to aspects of the present disclosure. Bowl insert 110*b* comprises an outer peripheral wire-frame element 315 that can rest on the ledge 105 of frame 102. Peripheral wire-frame element 315 can comprise at least two spaced side elements 322 that along with a front element 321 and a back element 323 form a complete rectangle. One or more support elements 107*b* in the form of wire-frame cross members 325 spanning the spaced side elements 322 can be configured to receive dishware. Insert 110*b* can further comprise one or more longitudinally arranged stabilizing wires 320 spanning the front element 321 and the back element 323 that can support dishes loaded onto the insert 110*b* and can provide additional support to the insert 110*b* to prevent insert 110*b* from deforming under the weight of the dishes.

The wire-frame cross members 325 can be in any suitable configuration to create a profile in which to receive bowls for washing. In the present example, the wire-frame cross members 325 are arranged in pairs of spaced or offset cross members 325, with the first cross member 325 of the pair having one peak 340 near a mid-point and the other cross member 325 having spaced peaks 346, 348. The pairs of cross members 325 can also be thought of as interleaved cross members 325, with differing numbers of peaks. The wire-frame cross members 325 can be fixedly attached at a first end 335 and a second end 337 to peripheral wire-frame element 315.

Figure 6B:
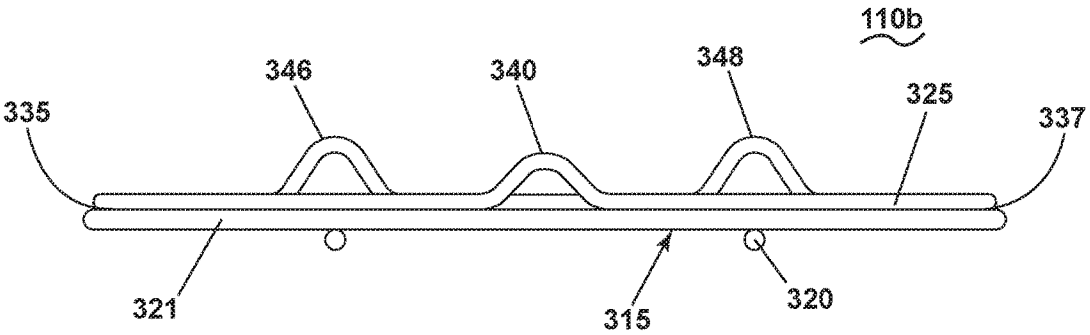
FIG. 6B is a front view of the profile of the bowl dishrack insert of FIG. 6A.

Referring to FIG. 6B, the peak 340 can be of a different height than the peaks 346, 348. More specifically, peaks 346 and 348 can be taller than the peak 340 to better hold a bowl on its side.

Figure 6C:
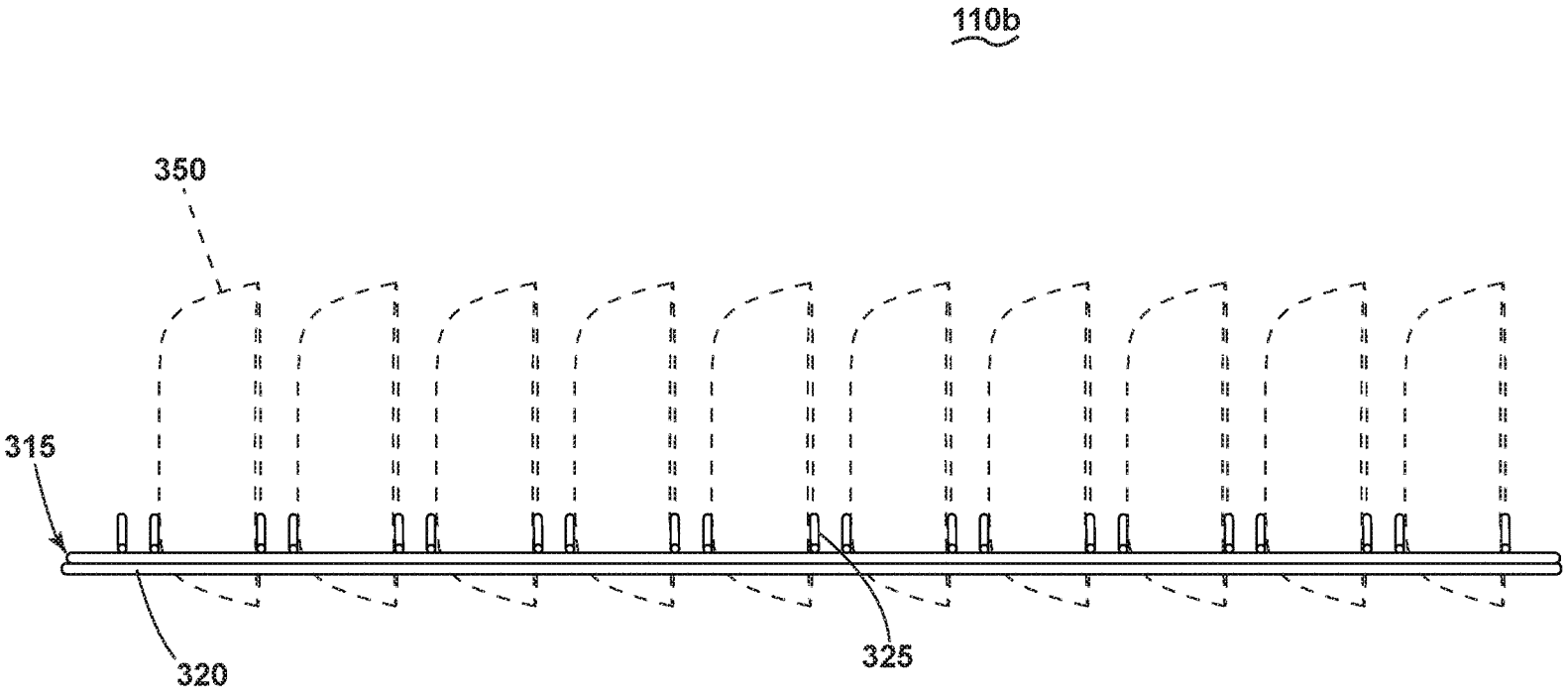
FIG. 6C is a side view of the bowl dishrack insert of FIG. 6A for illustrative purposes.

Referring to FIG. 6C, for the purposes of illustration, the interleaved profile configuration of the wire-frame cross members 325 creates a space for a bowl 350 or other similarly shaped dish to lie therebetween a pair of wire-frame cross members 325 where the rim of the bowl 350 can be supported by peak 340 while the bottom of the bowl 350 can be supported by peaks 346 and 348. The side of the bowl 350 can be supported by the longitudinal stabilizing wires 320 such that the bowl 350 can extend below a plane defined by the peripheral wire frame element 315.

Figure 7A:
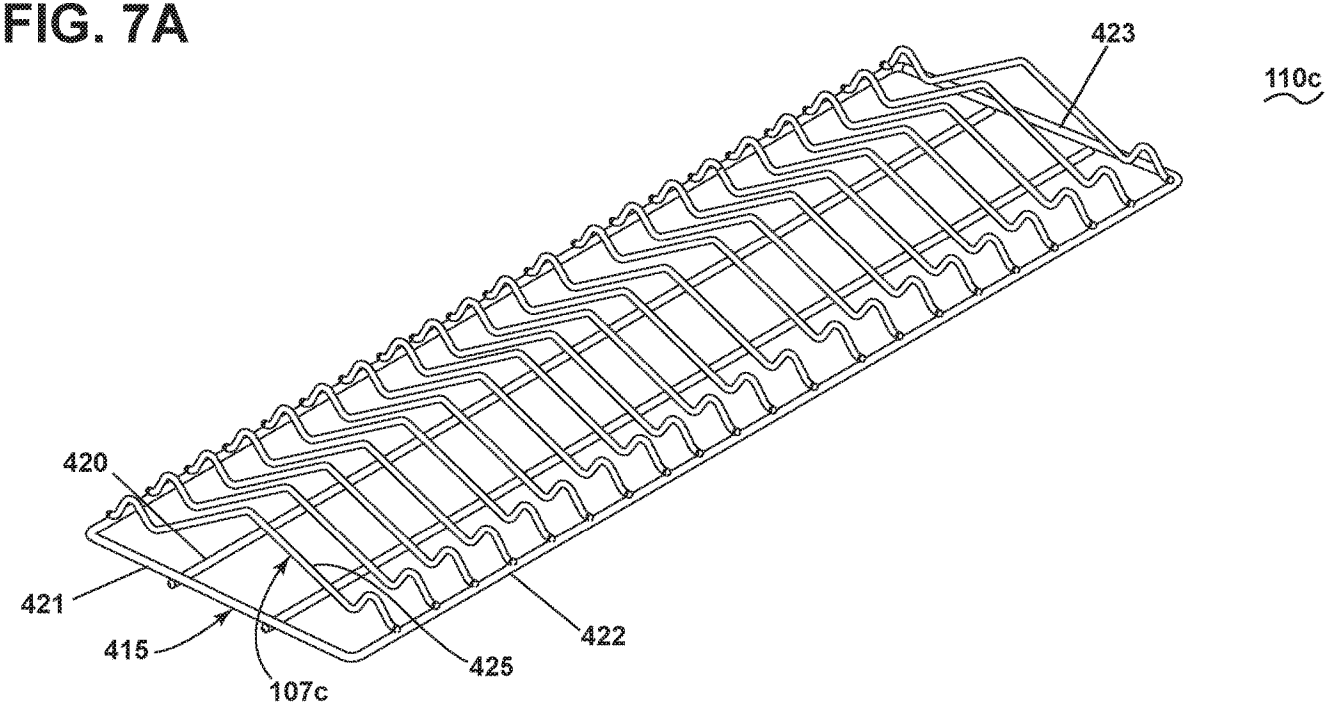
FIG. 7A is a perspective view of a plate dishrack insert according to aspects of the present disclosure.

FIG. 7A is a perspective view of a dishrack insert 110*c* for receiving plates of dishwasher 10 according to aspects of the present disclosure. The plate insert 110*c* comprises an outer peripheral wire-frame element 415 that can rest on the ledge 105 of frame 102. Peripheral wire-frame element 415 can comprise at least two spaced side elements 422 along with a front element 421 and a back element 423 for a complete rectangle. One or more support elements 107*c* in the form of wire-frame cross members 425 spanning the spaced side elements 422 can be configured to receive dishware. Insert 110*c* can further comprise one or more longitudinally arranged stabilizing wires 420 spanning the front element 421 and the back element 423 that can support dishes loaded onto the insert 110*c* and can provide additional support to the insert 110*c* to prevent insert 110*c* from deforming under the weight of the dishes.

Figure 7B:
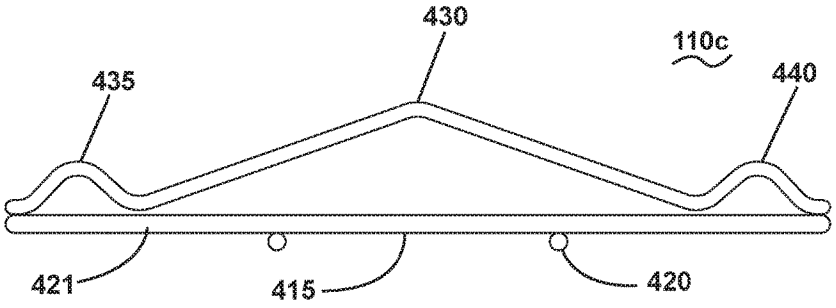
FIG. 7B is a front view of the profile of the plate dishrack insert of FIG. 7A.

Referring to FIG. 7B, the wire-frame cross members 425 can be in any suitable configuration to create a profile in which to receive dishes for washing. In the present example, the wire-frame cross members 425 can comprise a chevron profile comprising a chevron peak 430 and two peaks 435 and 440 disposed on opposite sides of the chevron peak 430.

Figure 7C:
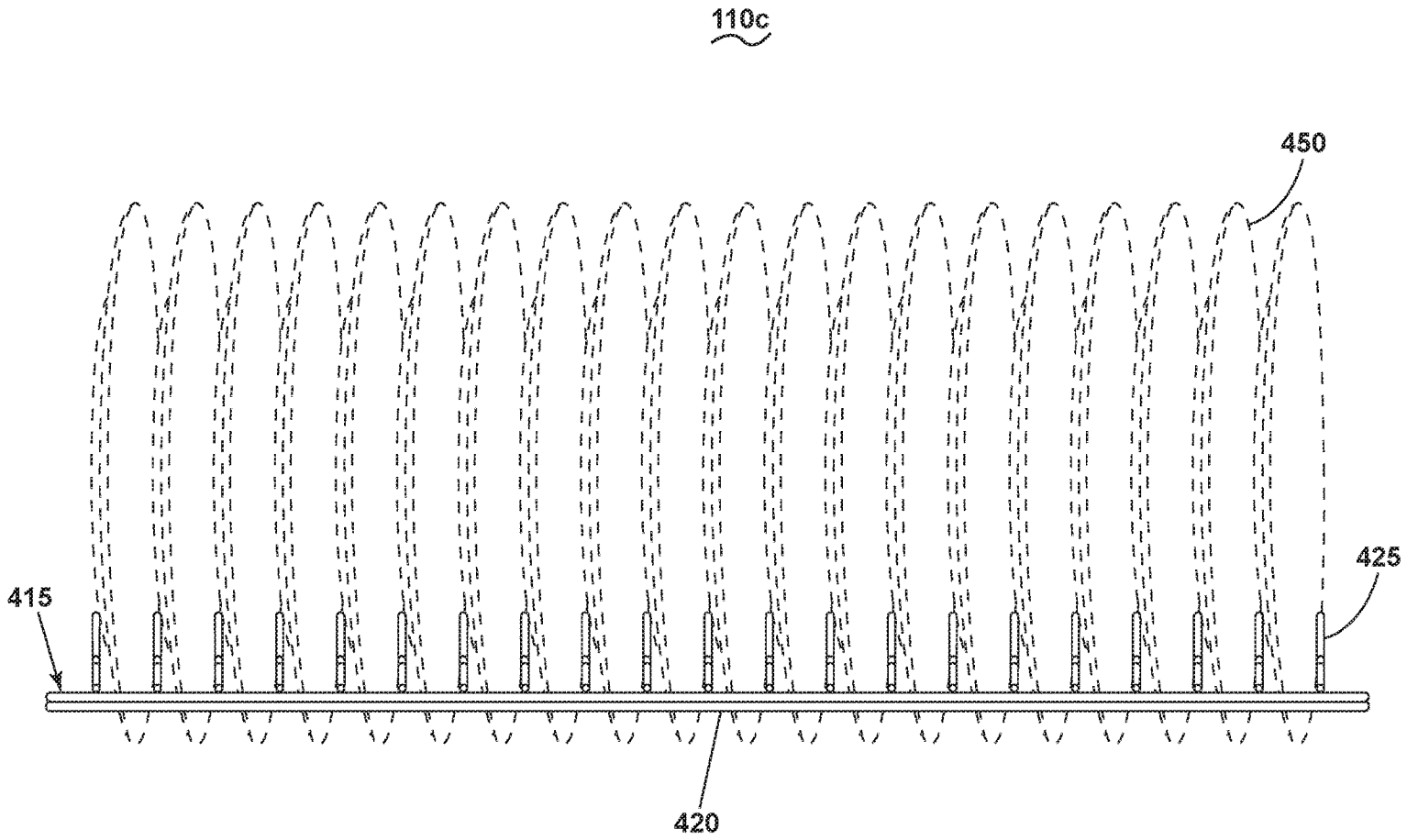
FIG. 7C is a side view of the bowl dishrack insert of FIG. 7A for illustrative purposes.

Referring to FIG. 7C, for the purposes of illustration, the chevron profile configuration of the wire-frame cross members 425 of insert 110*c* creates a space for a plate 450 or other similarly shaped dish to lie therebetween a pair of wire-frame cross members 425. Side peaks 435 and 440 of the front wire-frame cross member 425 can support the front of the plate 450 near its edges while the chevron peak 430 of the rear wire-frame cross member 425 can support the bottom of the plate 450 near its center. The side edge of the plate 450 can be supported by the longitudinal stabilizing wires 420 such that the plate 450 can extend below a plane defined by the peripheral wire-frame element 415.

While aspects of the present disclosure have included three inserts 110*a-c* in a dishrack 100 configuration, it will be understood that the configuration of the dishrack can comprise any number of inserts. Further still, any of the number of inserts can be of differing widths including, but not limited to, where one insert can span the entire width of frame. As yet another alternative, a first insert can have a first width and a second insert can have a second width, different from the first. Additionally, the inserts can be configured to span all of the interior of the frame or only a portion of the frame such that there is an open location, not covered by any insert, in the interior of the frame. Furthermore, the placement, profile, or configuration of the inserts in the frame can correspond to different spray zones in a dishwasher such that dishes are held in specific locations to obtain better cleaning performance.

Further still, while three inserts having varying shapes, profiles, or contours were illustrated, it will be understood that any inserts included can be configured in any suitable manner. By way of non-limiting example, a plurality of the included inserts can have the same profiles. Alternatively, it is contemplated that a single insert can have a combination of one or more profiles different from each other.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishrack for a dishwasher comprising:

a non-wire-frame frame forming a lower periphery of the dishrack with a bounded interior opening and having an upper surface and a ledge located on an exterior of the non-wire-frame, below the upper surface, to form a seat;

at least one wire-frame insert having a peripheral wire-frame element removably resting on the ledge within the seat and a plurality of wire-frame cross-members spanning the peripheral wire-frame element;

wherein the at least one wire-frame insert overlies and functionally closes at least a portion of the bounded interior when the peripheral wire-frame element rests on the ledge;

wherein the peripheral wire-frame element has at least two spaced side elements and further comprises multiple, spaced wire-frame cross members spanning the spaced side elements; and wherein the cross members comprise a first set with a first number of peaks and a second set with a second number of peaks, different than the first number.

2. A dishrack for a dishwasher comprising:

a peripheral non-wire frame defining an interior opening and comprising an upper surface and a ledge, located on an exterior of the non-wire frame below the upper surface, to form a seat;

a first insert removably resting on at least a portion of the frame within the seat, overlying and functionally closing at least a portion of the interior opening, and having a first set of support elements shaped to support glasses;

a second insert removably resting on at least a portion of the frame within the seat, overlying and functionally closing at least a portion of the interior opening, and having a second set of support elements shaped to support bowls; and a third insert removably resting on at least a portion of the frame within the seat, overlying and functionally closing at least a portion of the interior opening, and having a third set of support elements shaped to support plates wherein the first, second and third support elements define first, second, and third profiles, each of the first, second and third profiles being different.

3. A dishwasher comprising:

a tub at least partially defining a wash chamber with an access opening;

a first dishrack movably mounted to the tub; and a second dishrack having a peripheral non-wire frame defining an interior opening and having an upper surface and a ledge located on an exterior of the non-wire frame below the upper surface to form a seat, and at least a first and second removable dishracks supported on the peripheral frame within the seat, overlying and functionally closing at least a portion of the interior opening, and having corresponding first and second sets of support elements having corresponding first and second profiles, with the first and second profiles being different wherein the first profile is shaped to support a first dish and the second profile is shaped to support a second dish, which is different from the first dish; and wherein the first and second profiles are at least one of stepped, chevron, and varying projections.

4. The dishrack of claim 1 wherein the cross members comprise a stepped profile and collectively define at least two effectively planar surfaces.

5. The dishrack of claim 1 wherein first and second sets are interleaved.

6. The dishrack of claim 1 wherein the cross members comprise a chevron profile.

7. The dishrack of claim 6 comprising two peaks disposed on opposite sides of the chevron profile.

8. The dishrack of claim 1 wherein the at least one wire-frame insert comprises three wire-frame inserts, each having wire-frame cross members, with the wire-frame cross members of each insert having a different profile suitable for a different dish to define first, second and third profiles.

9. The dishrack of claim 8 wherein the first profile is suitable for glasses, the second profile is suitable for bowls, and the third profile is suitable for plates.

10. The dishrack of claim 2 wherein the first, second and third inserts are supported on different portions of the peripheral frame within the seat.

11. The dishrack of claim 10 wherein the first, second and third inserts are arranged side-by-side.

12. The dishrack of claim 2 wherein at least one of the first, second and third support elements is a wire-frame element.

13. The dishwasher of claim 3 wherein the first and second dishes are at least one of glasses, bowls and plates.

14. The dishwasher of claim 3 wherein the frame is a non-wire-frame and the support elements are wire-frame.

15. The dishrack of claim 1 wherein the at least one wire-frame insert has at least a portion extending above the lower periphery.

* * * * *